US010118673B1

(12) United States Patent
Carlucci et al.

(10) Patent No.: US 10,118,673 B1
(45) Date of Patent: Nov. 6, 2018

(54) ADJUSTABLE DOCK HANDLE

(71) Applicants: Richard Carlucci, Warwick, RI (US); Nga Le, Warwick, RI (US)

(72) Inventors: Richard Carlucci, Warwick, RI (US); Nga Le, Warwick, RI (US)

( * ) Notice: Subject to any disclaimer, the term of this patent is extended or adjusted under 35 U.S.C. 154(b) by 12 days.

(21) Appl. No.: 15/413,518

(22) Filed: Jan. 24, 2017

(51) Int. Cl.

| | |
|---|---|
| ***B63B 21/00*** | (2006.01) |
| ***B63B 21/54*** | (2006.01) |
| ***E02B 3/06*** | (2006.01) |
| *B63B 29/06* | (2006.01) |

(52) U.S. Cl.
CPC ..... *B63B 21/54* (2013.01); *E02B 3/068* (2013.01); *B63B 29/06* (2013.01); *B63B 2021/001* (2013.01)

(58) Field of Classification Search
CPC ... B63B 21/54; B63B 21/00; B63B 2021/001; B63B 2021/002; B63B 21/04; B63B 21/045; B63B 23/18
See application file for complete search history.

(56) References Cited

U.S. PATENT DOCUMENTS

| | | | | |
|---|---|---|---|---|
| D308,192 | S | 5/1990 | Ellison | |
| 6,513,449 | B1 | 2/2003 | Stewart | |
| 6,637,360 | B2 | 10/2003 | Vretta | |
| 6,783,303 | B2 | 8/2004 | Snyder | |
| 6,823,811 | B1 | 11/2004 | Drake | |
| 7,100,527 | B2 * | 9/2006 | Munro | B63B 21/00 114/230.15 |
| 7,789,033 | B2 * | 9/2010 | Doig | B63B 21/00 114/230.15 |
| 9,205,893 | B2 * | 12/2015 | Posner | B63B 21/00 |
| 2009/0107384 | A1 | 4/2009 | Stephenson | |

* cited by examiner

*Primary Examiner* — Andrew Polay
(74) *Attorney, Agent, or Firm* — Kyle A. Fletcher, Esq.

(57) ABSTRACT

The adjustable dock handle is a device that is adapted to be attached to a top surface or a side surface of a dock, and which includes a handle that is used to help manipulate a boat during a docking process. The end user may easily reach the handle in order to pull the boat into position for mooring, and which will provide the support and stability needed to independently control the boat while docking.

14 Claims, 5 Drawing Sheets

ADJUSTABLE DOCK HANDLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of boating accessories, more specifically, provides a safer and more effective way to independently dock a boat.

SUMMARY OF INVENTION

The adjustable dock handle is a device that is adapted to be attached to a top surface or a side surface of a dock, and which includes a handle that is used to help manipulate a boat during a docking process. The adjustable dock handle is further defined with a base that is adapted to be secured to a top surface or a side surface of the dock. The base is attached to a rotating cover that is in turn connected to a pole. The pole includes a handle that is distal from the base. The handle and the pole are able to swivel and pivot with respect to the base via the rotating cover in order to provide different configurations of use. The base attaches to the rotating cover such that the rotating cover is able to rotate with respect to a vertical axis. The pole is pivotably attached to the rotating cover. A ratchet member is provided betwixt the pole and the rotating cover in order to provide a biasing force that returns the handle to a vertical orientation. An elastic cord extends from the handle through the pole and to the base. The elastic cord aids in biasing the handle to a vertical orientation.

These together with additional objects, features and advantages of the adjustable dock handle will be readily apparent to those of ordinary skill in the art upon reading the following detailed description of the presently preferred, but nonetheless illustrative, embodiments when taken in conjunction with the accompanying drawings.

In this respect, before explaining the current embodiments of the adjustable dock handle in detail, it is to be understood that the adjustable dock handle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the adjustable dock handle.

It is therefore important that the claims be regarded as including such equivalent construction insofar as they do not depart from the spirit and scope of the adjustable dock handle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
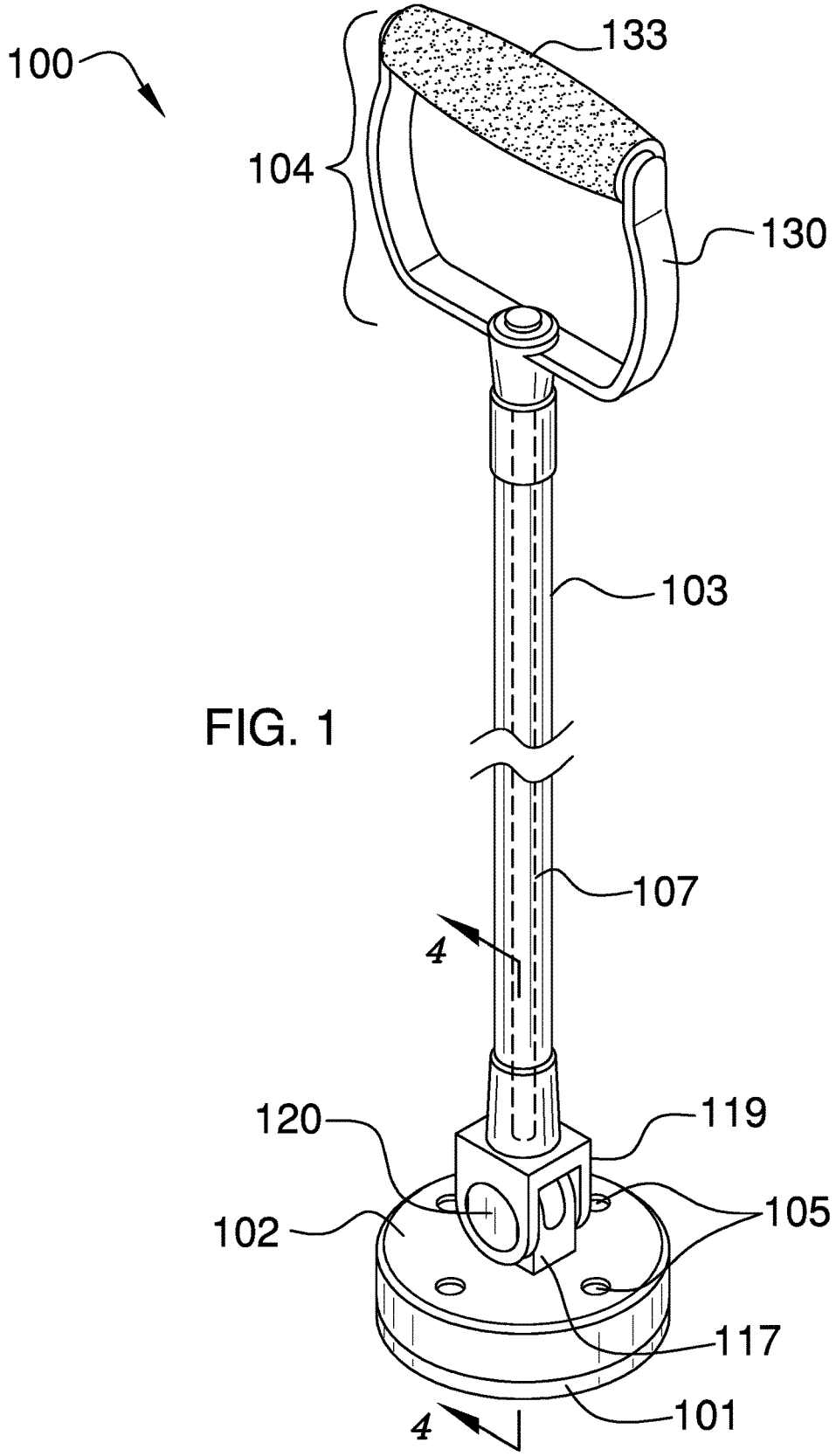
FIG. 1 is a perspective view of an embodiment of the disclosure.
Figure 2:
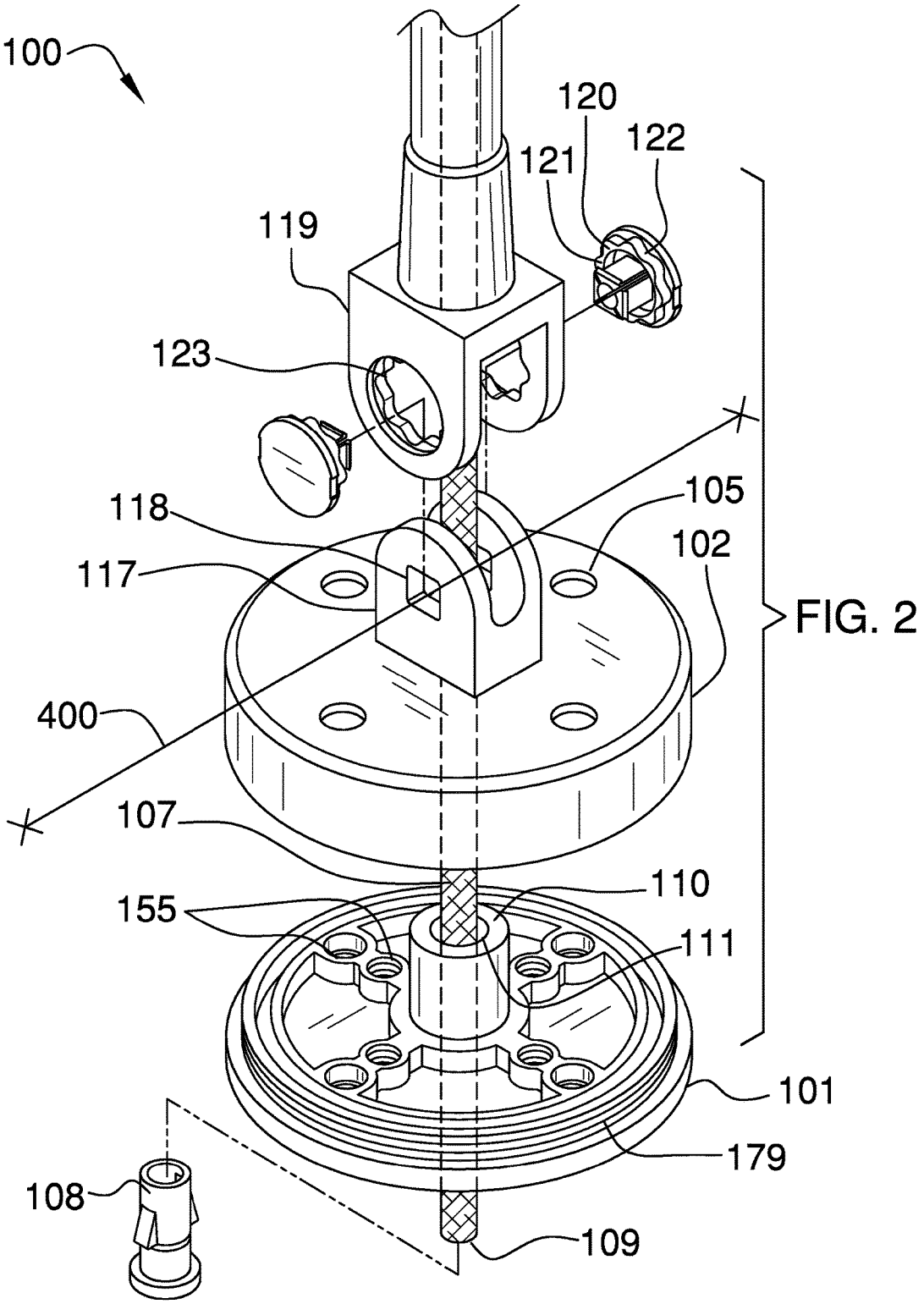
FIG. 2 is a close-up, exploded view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a plurality of potential embodiments of the disclosure, which are illustrated in FIGS. 1 through 6.

The adjustable dock handle 100 (hereinafter invention) comprises a base 101 that is adapted to be rigidly affixed onto a top dock surface 201 or a side dock surface 220 of a dock 200. The base 101 is further defined with a base connector 102 that interacts with a pole 103. The pole 103 is of an undefined length, and includes a handle 104 on a distal end.

The base connector 102 is a rotating member that is able to rotate with respect to the base 101. The base connector 102 includes a plurality of base connector holes 105, which enable fastening members 106 to extend into the base 101 for adaptive securement of the invention 100 to the top dock surface 201 or the side dock surface 220 of the dock 200.

The invention 100 includes a flexible cord 107 that extends through the pole 103. A cord connector 108 is included and interfaces with a distal end 109 of the flexible cord 107. The cord connector 108 is positioned underneath the base 101. More specifically, the cord connector 108 is centrally positioned underneath the base 101. The base 101 has a cord collar 110 that is concentrically positioned on the base 101. The cord collar 110 features a cord hole 111 through which the flexible cord 107 extends, but the cord connector 108 is seated against from underneath the base 101.

The base 101 is adapted to be rigidly affixed to the dock surface 201 or the side dock surface 220 of the dock 200. The base connector 102 is able to rotate with respect to the base 101 along a vertical axis 300. Moreover, the base connector 102 is able to move either clockwise or counterclockwise with respect to the vertical axis 300. It shall be noted that the flexible cord 107 is concentric with respect to the vertical axis 300. The base connector 102 includes an inner groove 177 along an inner surface 178 that interfaces with an external groove 179 of the base 101. The inner groove 177 of the base connector 102 and the external groove 179 of the base 101 enables rotational movement of the base connector 102 with respect to the vertical axis 300.

The base 101 includes a plurality of fastening member holes 155 that enable the fastening members 106 to adaptively and rigidly affix the base 101 to the dock 200. The base 101 works in concert with the base connector 102 to ensure that the base connector 102 is only able to rotate with respect to the vertical axis 300, and which may be either clockwise or counterclockwise.

Extending vertically from the base connector 102 of the base 101 is a pair of brackets 117. The pair of brackets 117 mirror one another, and are generally parallel with one another. The pair of brackets 117 each include a square hole 118 thereon. The pole 103 includes a pivot connector 119 that connects to the pair of brackets 117. A pair of ratchet members 120 are included and are positioned betwixt the pair of brackets 117 and the pivot connector 119. Each of the pair of ratchet members 120 includes a square protuberance 121 that interfaces with the square hole 118 of a corresponding one of the pair of brackets 117.

A second protuberance 122 is included on each of the pair of ratchet members 120. The second protuberance 122 interfaces with a ratchet opening 123 provided on the pivot connector 119. The ratchet opening 123 and the second protuberance 122 provides governance over the rotation of the pole 102 with respect to the base connector 102. The pivot connector 119 includes the ratchet opening 123, which works in concert with the pair of ratchet members 120 to ensure rotational movement of the pivot connector 119 with respect to pair of brackets 117 is accommodated at differing rotational increments. The pivot connector 119 is able to rotate with respect to the base 101 along a horizontal axis 400.

The handle 104 may be further defined as a "U"-shaped bracket 130 that is rigidly affixed to a distal end 131 of the pole 103. A third fastener 132 is used to rigidly affix the "U"-shaped bracket 130 to the pole 103. The third fastener 132 comprises a rivet, bolt, screw, nail, etc. The "U"-shaped bracket 130 includes a bulbous member 133 that extends there between. The bulbous member 133 is adapted to interface with the boat 500 or be manually grasped. The bulbous member 133 is made of a soft material comprising a visco elastic foam, rubber, etc.

Figure 3:
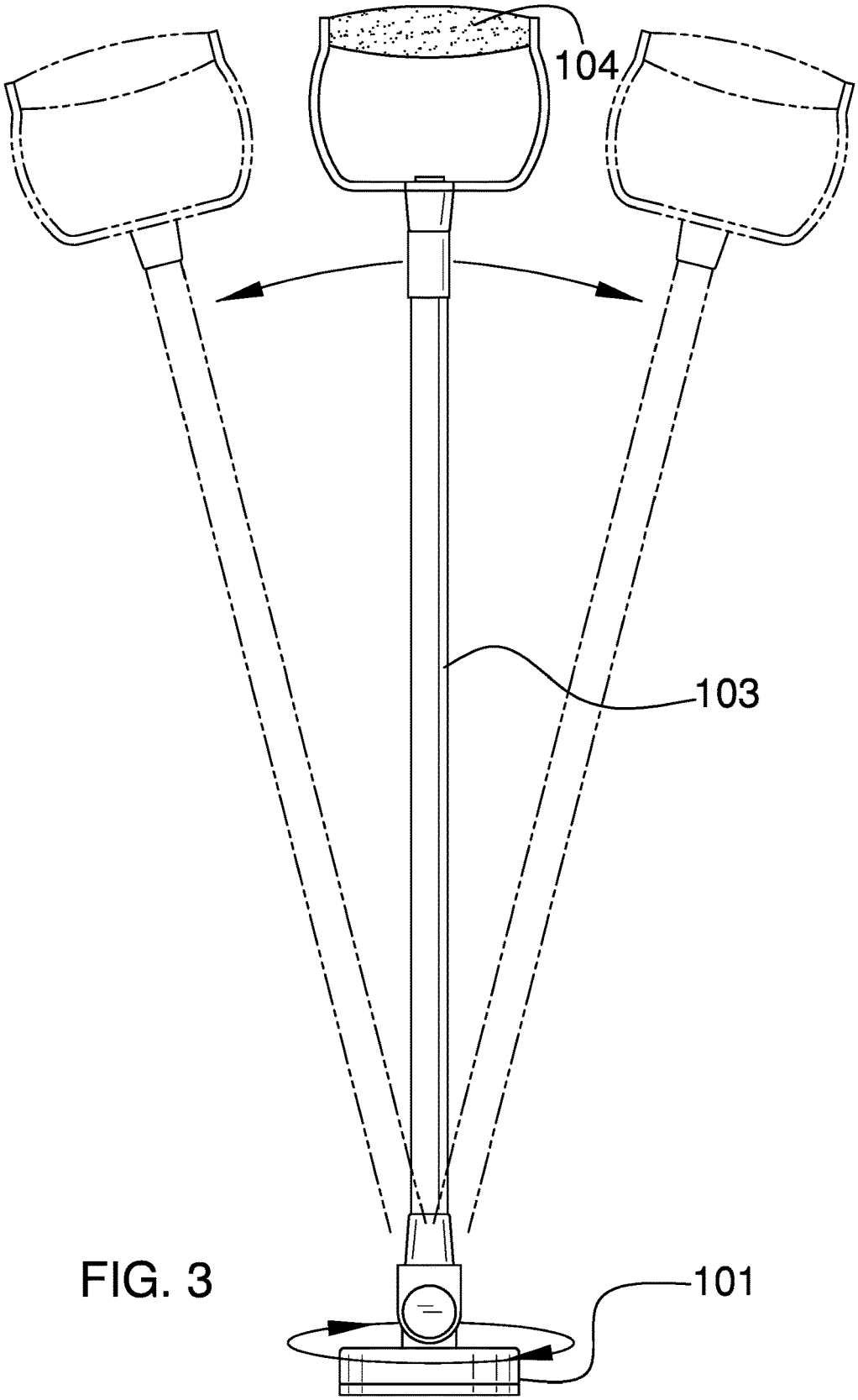
FIG. 3 is a side view of an embodiment of the disclosure.
Figure 5:
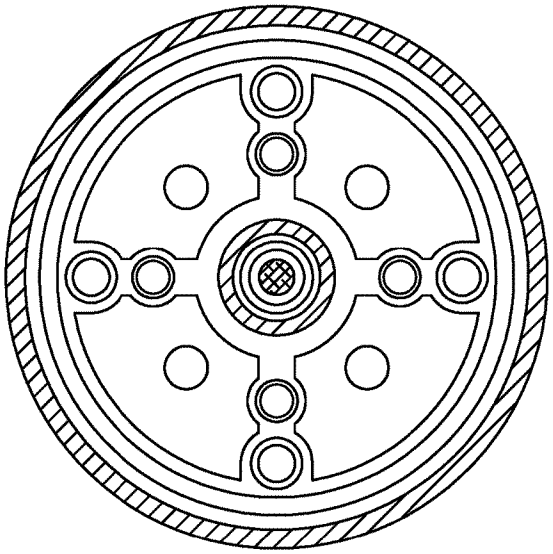
FIG. 5 is a cross-sectional view of an embodiment of the disclosure along line 5-5 in FIG. 4.
Figure 4:
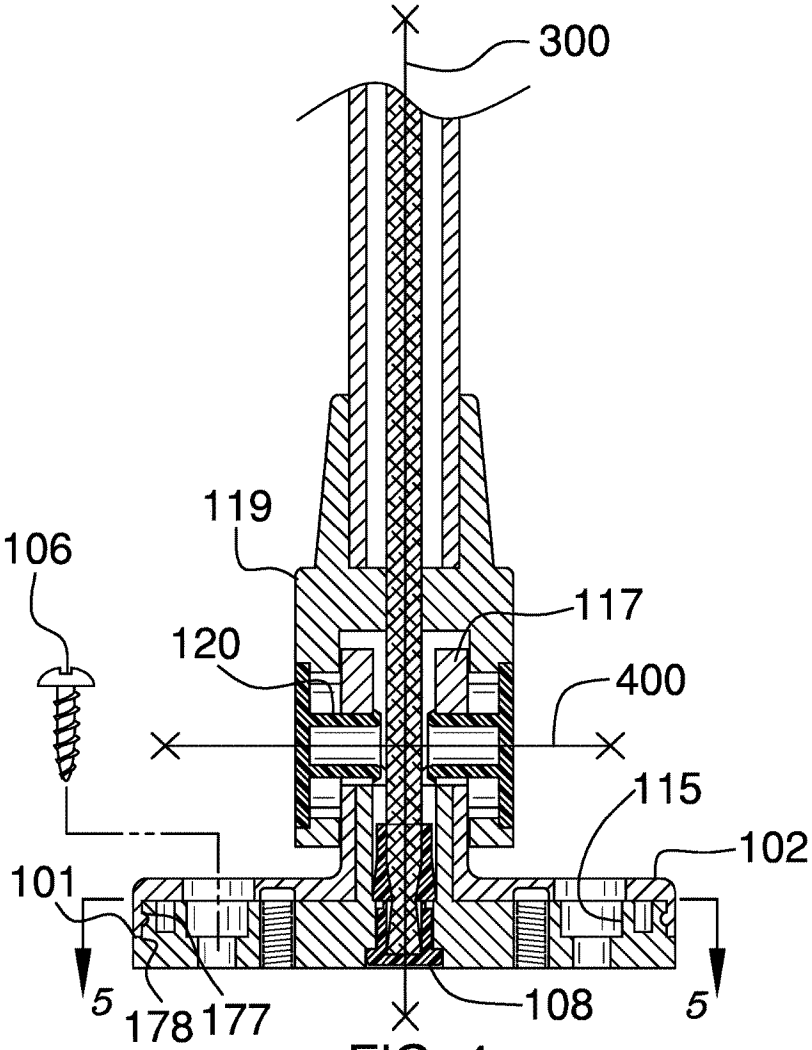
FIG. 4 is a cross-sectional view of an embodiment of the disclosure along line 4-4 in FIG. 1.
Figure 6:
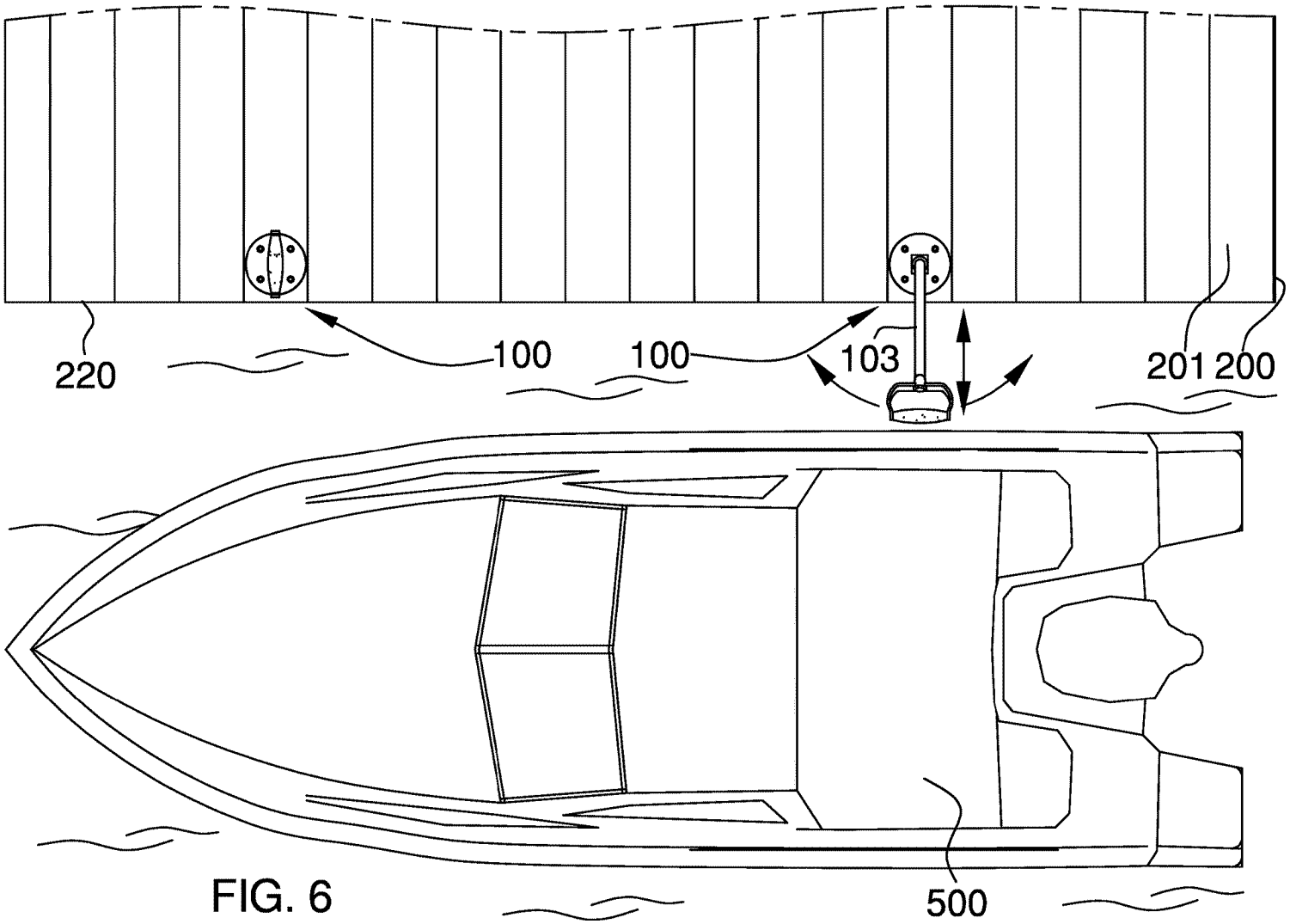
FIG. 6 is a top view of an embodiment of the disclosure in use.

Referring to FIG. 3, the rotational arrows indicate the rotational movement of the handle 104 as well as the pole 103 with respect to the base 101. All componentry of the invention 100 may be made of a wide variety of materials comprising, wood, plastic, carbon fiber composite, metal, etc. It shall be noted that the pole 103 has no definitive length or outer diameter.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A docking accessory for a water vessel comprising:
- a base with a pole extending therefrom;
- wherein a handle is affixed to an end of said pole;
- wherein the base is adapted to be affixed to a dock;
- wherein the handle is adapted to be manipulated via an end user during docking of a boat;
- wherein the base is adapted to be affixed onto a top dock surface or a side dock surface of said dock;
- wherein the base is further defined with a base connector that interacts with the pole;
- wherein the pole is of hollowed construction, and includes a handle on the end of said pole;
- wherein the base connector is a rotating member that is able to rotate with respect to the base;
- wherein the base connector includes a plurality of base connector holes, which enable fastening members to extend into the base for securement of the docking accessory to the top dock surface or the side dock surface of the dock;
- wherein the base connector is a bracket with the plurality of base connector holes thereon;
- wherein a flexible cord that extends through the pole;
- wherein a cord connector is included and interfaces with an end of the flexible cord;
- wherein the cord connector is positioned underneath the base;
- wherein the cord connector is centrally positioned underneath the base;
- wherein the cord connector has a cylinder shape and is a cap for the rope.

2. The docking accessory according to claim 1 wherein the base has a cord collar that is concentrically positioned on the base; wherein the cord collar features a cord hole through which the flexible cord extends, but the cord connector is seated against the cord collar from underneath the base.

3. The docking accessory according to claim 2 wherein the base connector is able to rotate with respect to the base along a vertical axis; wherein the base connector is able to move either clockwise or counterclockwise with respect to the vertical axis.

4. The docking accessory according to claim 3 wherein the flexible cord is concentric with respect to the vertical axis.

5. The docking accessory according to claim 4 wherein the base connector includes an inner groove along an inner surface that interfaces with an external groove of the base; wherein the inner groove of the base connector and the external groove of the base enables rotational movement of the base connector with respect to the vertical axis.

6. The docking accessory according to claim 5 wherein the base includes a plurality of fastening member holes that enable the fastening members to adaptively and rigidly affix the base to the dock.

7. The docking accessory according to claim 6 wherein extending vertically from the base connector of the base is a pair of brackets.

8. The docking accessory according to claim 7 wherein the pair of brackets mirror one another, and are generally parallel with one another; wherein the pair of brackets each include a square hole thereon.

9. The docking accessory according to claim 8 wherein the pole includes a pivot connector that connects to the pair of brackets.

10. The docking accessory according to claim 9 wherein a pair of ratchet members are included and are positioned betwixt the pair of brackets and the pivot connector.

11. The docking accessory according to claim 10 wherein each of the pair of ratchet members includes a square protuberance that interfaces with the square hole of a corresponding one of the pair of brackets.

12. The docking accessory according to claim 11 wherein a second protuberance is included on each of the pair of ratchet members; wherein the second protuberance interfaces with a ratchet opening provided on the pivot connector; wherein the ratchet opening and the second protuberance provides governance over the rotation of the pole with respect to the base connector; wherein the pivot connector includes the ratchet opening, which works in concert with the pair of ratchet members to ensure rotational movement of the pivot connector with respect to pair of brackets is accommodated at differing rotational increments; wherein the pivot connector is able to rotate with respect to the base along a horizontal axis.

13. The docking accessory according to claim 12 wherein the pole extends from the pivot connector to the handle; wherein the handle extends outwardly with respect to the dock in order to interface with said boat during a docking event of said boat.

14. The docking accessory according to claim 13 wherein the handle is further defined as a "U"-shaped bracket that is rigidly affixed to said end of the pole; wherein a third fastener is used to rigidly affix the "U"-shaped bracket to the pole; wherein the "U"-shaped bracket includes a bulbous member that extends there between; wherein the bulbous member is adapted to interface with the boat or be manually grasped.

* * * * *